United States Patent [19]

Hupp et al.

[11] 3,985,062

[45] Oct. 12, 1976

[54] FIREARM CONSTRUCTION

[75] Inventors: Gerhard Hupp, Oberndorf (Neckar); Helmut Mader, Schramberg, both of Germany

[73] Assignee: Industriewerke Karlsruhe-Augsburg Aktiengesellschaft, Germany

[22] Filed: Feb. 20, 1975

[21] Appl. No.: 551,154

[30] Foreign Application Priority Data

Feb. 21, 1974 Germany ..... 2408446

[52] U.S. Cl. ..... 89/159; 89/179

[51] Int. Cl.[2] ..... F41D 15/04

[58] Field of Search ..... 89/179, 159, 172, 185

[56] References Cited

UNITED STATES PATENTS

| | | | |
|---|---|---|---|
| 1,132,044 | 3/1915 | Stamm | 89/172 X |
| 2,537,443 | 1/1951 | Cerrella | 89/179 X |
| 2,941,449 | 6/1960 | Reed | 89/185 |
| 3,641,692 | 2/1972 | Wells | 89/179 UX |
| 3,713,363 | 1/1973 | Hurlemann | 89/185 |
| 3,855,900 | 12/1974 | Barr et al. | 89/159 |

FOREIGN PATENTS OR APPLICATIONS

| | | | |
|---|---|---|---|
| 697,256 | 9/1940 | Germany | 89/159 |

*Primary Examiner*—David H. Brown
*Attorney, Agent, or Firm*—McGlew and Tuttle

[57] ABSTRACT

A firearm, particularly a short firearm for firing caseless ammunition, comprises a housing having a sleeve fixed therein with first and second spring members which are biased against a projection on the gun barrel in order to hold it against axial displacement in each direction. The barrel includes a breech portion with a magazine chamber, and cartridges are moved out of the magazine chamber into a cartridge chamber by a gas piston which is displaceable in a lock member which, together with the gas piston, seals the space in the cartridge chamber behind the cartridge during firing. The lock member includes projections which are engaged behind recesses of the rear breech portion of the barrel. The firing pin gas piston is moved rearwardly during firing, and it has a pin connection to a lock slider so that it and the lock member are rotated to move the projection on the lock member out of alignment with the projections of the breech portion of the barrel so that the lock member and the firing pin may be tracked against the force of a return spring. In a subsequent forward movement of the firing pin and the lock member, the next cartridge in the magazine is positioned in the cartridge chamber with the projectile portion located in the barrel for firing.

8 Claims, 3 Drawing Figures

R max.
V max.
0
1. 2. 3.
CONSECUTIVE SHOTS
RECOIL AND COUNTER-RECOIL

FIREARM CONSTRUCTION

FIELD AND BACKGROUND OF THE INVENTION

This invention relates in general to the construction of firearms, and in particular, to a new and useful firearm having first and second damping springs which come into successive action on the gun barrel which is movably mounted in the gun housing and which also includes a firing pin designed as a gas piston which is moved rearwardly during firing and engaged with control members to release the locking member after firing.

DESCRIPTION OF THE PRIOR ART

The present invention relates particularly to a firearm, such as a short hand arm, which is preferably employed with caseless ammunition, and which includes a closing and rigidly lockable breech mechanism which forms a unit with the barrel of the arm. In accordance with their function, opening and closing breech mechanisms may be distinguished in semi-or fully automatic small firearms. In contrast to opening breech systems, the closing systems, are subject to some loss in precision at the first shot in succession because of the rushing or moving of the breech piece into the locking position in a rigidly mounted system which causes an impact leading to an error in a departure, such as a jump of the arm.

In recent times, both for tactical and logistic reasons, small arms are required to be capable of firing caseless ammunition instead of conventional ammunition. Caseless ammunition comprises a projectile and a case without a cartridge housing. The construction makes it possible to store a greater number of cartridges depending upon the design of the arm and the magazine associated therewith. Greater firing power is thereby given to the individual rifleman. Also, the small weight of the caseless ammunition permits the rifleman to carry a larger quantity of ammunition in battle. This makes him more independent of the problems of logistics. On the other hand, the larger quantity of ammunition at the disposal of the rifleman tempts him to use it in excess undesirably. In order to avoid this tendency, it is known to limit the successive firing of small arms, for example, to a series of three rounds. If, in accordance with the foregoing explanation, the design of a small firearm is directed to a closing breech system and to the use of caseless ammunition, the advantages and disadvantages are not compensated automatically without particular constructional measures even though the use of caseless ammunition in itself undoubtedly has a positive effect in the elimination of the so-called "cooking off" phenomena which is generally feared.

Many types of constructions are known for fire interruption. For example, a tooth rim may be provided which upon actuation of the trigger turns by a tooth at a time and after a third shot, an interrupter becomes effective which interrupts the firing sequence. Thereupon first the trigger must be released before it can be actuated again and before the toothed rim continues to turn.

In addition, small firearms designed under consideration of the facts mentioned above are a problem because considerable expenses are necessary to provide a gas conduction inherent in the system in order to ensure a control of the unlocking of the breech without particular difficulties.

SUMMARY OF THE INVENTION

The present invention provides a small firearm which comprises a closing breech mechanism which avoids the drawbacks of the prior art and which permits the use of caseless ammunition in an economical and well-considered manner and which provides a gas conduction system for the unlocking of the breech which is simple and inexpensive in construction.

In accordance with the invention, the counter-recoil momentum imparted to the breech and barrel system at the discharge of the first shot of a series of three rounds is reduced to a well-defined value by a first damping member. Thereafter, a second damping member comes into action to reduce the recoil momentum which is effective after the passing of the inversion point of the system. At the same time, due to partial gas flows produced by the gas pressure in the cartridge chamber, the firing pin of the breech mechanism is designed as a gas piston which is moved rearwardly. The rearwardly moving firing pin is connected through control members to release a locking sliding member in which it is movable so that the firing pin and sliding member move rearwardly of the cartridge which has been fired.

Thus, in an advantageous embodiment of the invention, the recoil momentum produced at the firing is nullified by the provision of damping members due to the opposed action of the masses counteracting the forward thrust of the system. The damping members, in accordance with the invention, comprise helical compression springs. First and second helical compression springs are mounted concentrically around the barrel and they bear in respective opposite directions against a projection on the barrel. The two helical springs are surrounded in both their axial and radial extensions by a common guide sleeve which is removably fixed in the housing of the arm. The guide sleeve is provided in its interior with a shoulder which, along with a correspondingly designed shoulder on the barrel, and if necessary, with an interposed centering member or the like, forms one of the stops of the first helical spring. The other stop of the spring comprises a ring or the like which is fixed in the guide sleeve. The stops for the second helical spring are designed so that one is provided on the back side of the shoulder of the barrel, and the other stop is provided on a shoulder of the sleeve which is located at a location closer to the muzzle.

In accordance with a feature of the invention, the firing pin which slides in a lock slider is provided with a control pin or the like which rides in a groove of a lock slider control member to cause rotation of the firing pin and the lock member and its release thereby, during operation.

A small firearm having the features pointed out in the foregoing is relatively simple both as to its design and to its manufacture. It is evident that the costs of manufacture are reduced approximately to the same extent.

An arm designed in the manner of the invention has a further advantage in respect to the floating mounting of the barrel and breech system in the housing. This floating mounting is obtained by the support of the barrel within a sleeve mounted in the housing by two oppositely acting damping masses or springs. With such a construction, a completely secure guidance of the arm is ensured, thereby, eliminating departure errors.

A further advantage of the inventive firearm is that a relatively large amount of storable caseless ammunition may be employed therewith, and the ingenious and useful design of the firing pin as a gas piston effects the unlocking of the breech under the action of rearwardly directed partial gas flows.

Finally, the firearm of the invention has the advantage that despite its capability of storing ammunition, as compared with the conventional arms, it may be made of relatively light weight and be entirely insensitive to atmospheric influences, such as dust, mud or the like, and it has other advantages in respect to its small overall size and easy handling.

Accordingly, it is an object of the invention to provide an improved firearm, which includes a barrel which is suspended in the housing on two oppositely acting spring members, and which has a rear breech portion of the barrel with a cartridge chamber, which opens rearwardly to a magazine for caseless ammunition, and which includes a firing pin slidable in a lock member and forming a drive piston behind the cartridge and which is locked in a firing position by projections of the barrel and which moves rearwardly and is rotated during rearward movement to unlock the lock member surrounding it to permit further retreating movement against a return spring.

A further object of the invention is to provide a firearm which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figures 1, 2, 3:
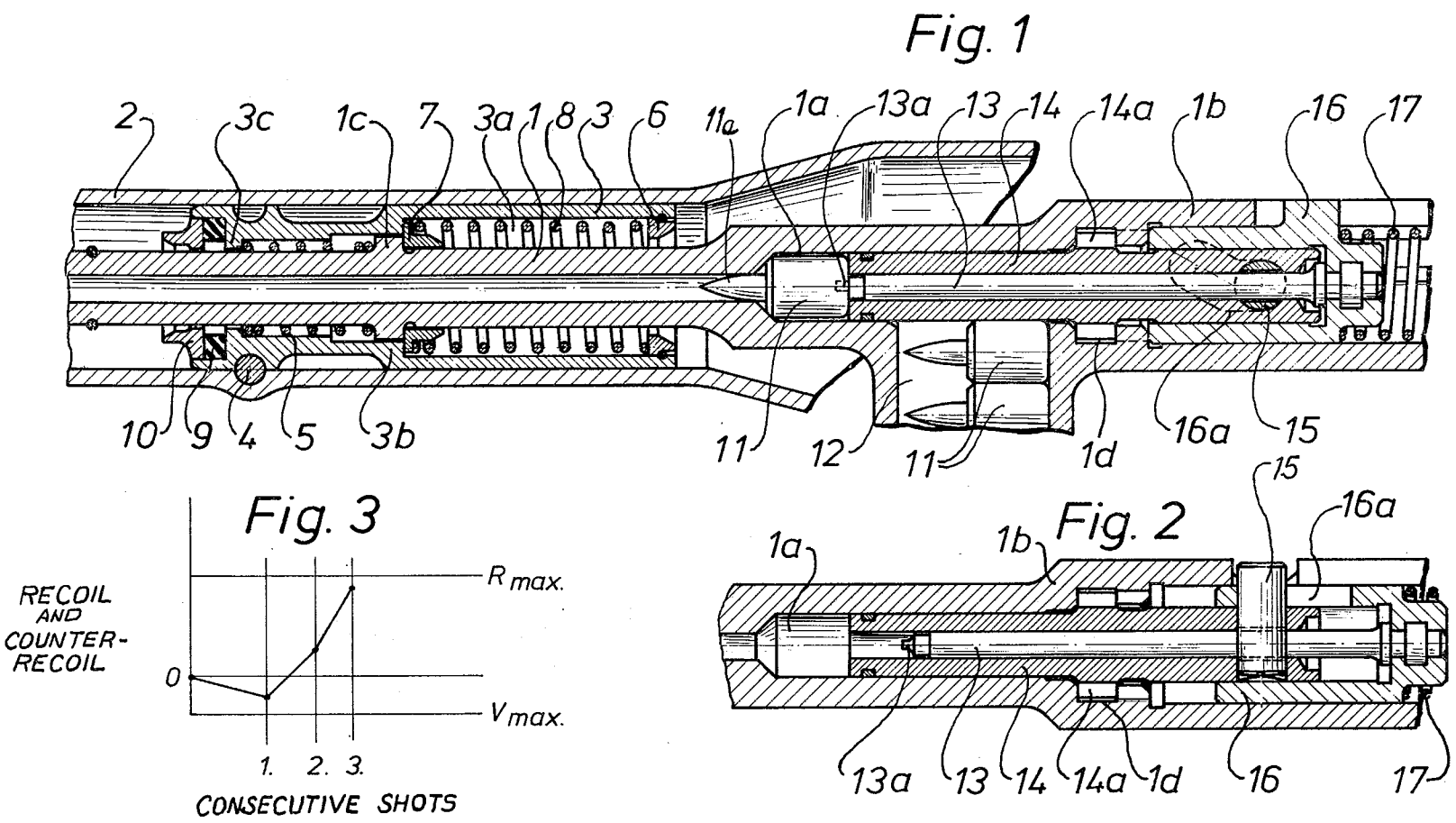
FIG. 1 is a partial longitudinal sectional view of a firearm constructed in accordance with the invention.
FIG. 2 is a partial sectional view of the breech mechanism shown in FIG. 1, with the system shown in an unlocked position.
FIG. 3 is a graph showing the forward and recoil motion of the masses inherent in the system related to the firing of a series of three successive shots.

Referring to the drawing in particular, the invention embodied therein, comprises a gun barrel, generally designated 1, which is arranged within a housing 2 of the firearm concentrically within a guide sleeve 3 axially and rotatably fixed within the housing. Both the guide sleeve 3 and the barrel 1 are concentrically arranged within the housing 2 and the sleeve is fixed in position by means of a bolt or pin 4.

In accordance with one feature of the invention, a first biased compression spring or helical spring 8 is arranged concentrically around barrel 1 and is provided within the rear portion 3a of sleeve 3. An end of spring 8 which is near to the breech applies against a stop ring 6 which is axially and radially fixed in the guide sleeve 3 and its opposite end bears on an interposed centering ring 7 against a shoulder or abutment 1*c* provided on the barrel 1 and also against a portion of a corresponding shoulder 3*b* provided on the guide sleeve 3.

A second helical spring 5 is mounted in a manner similar to the mounting of spring 8 and has one end which rests against the backside of a shoulder 1*c* and an opposite end toward the muzzle of the gun which rests against a shoulder 3*c* which is provided in guide sleeve 3 at the end thereof near the muzzle. A shock absorber, such as a ring 9, is disposed between the sleeve 3 and a flange member 10 to close the muzzle side of the sleeve against barrel 1.

As shown in FIG. 1, a caseless cartridge 11 is employed with the gun and it is stored in a magazine 12 which connects upwardly into a cartridge chamber 1*a* formed at the end of the barrel bore. In the position shown in FIG. 1, one of the cartridges 11 is in a position in which it may be fired and it includes a projectile portion 11*a* which extends in the barrel bore. The point 13*a* of the firing pin 13 is shown in a position in which it has already ignited the primer for discharging cartridge 11. Firing pin 13 is mounted concentrically within a hollow lock member 14 and it is axially displaceable therein. The cartridge chamber behind cartridge 11 is sealed by the locked member and firing pin 13 which is constructed to function as a gas piston. Under the gas pressure which is developed in cartridge chamber 1*a*, at the time of the firing, the firing pin 13, formed the gas piston, is driven axially back in the lock member 14.

Control means associated with the firing pin 13 include a pin 15 which is loosely inserted in the lock member 14 and projects transversely therefrom. The firing pin 13 is designed as a gas piston and it is guided in a curved track 16*a* provided on the interior of the locking slider 16. Both the firing pin 13 and the slider 16 are thrown back by gas pressure during firing and during this backward motion the pin 15 in cooperation with control means, including curved track 16*a* of the locking slider 16 and the pin 15 engaged in the track, causes the rotation of the lock member 14 and the disengagement of the projections 14*a* and the lock member 14 from the conformable recesses 1*d* which are provided on the interior of the barrel breech part 1*b*. This clears the magazine 12, and a new caseless cartridge 11 is transported into the cartridge chamber 1*a* by the lock member 14 under the action of a return spring 17, which moves the lock member backwardly after firing. During the return movement of the lock member the pin 15 again follows the curved track 16*a* and causes rotation of the lock member so as to move projections 14*a* of the lock member so that they reengage with the recesses 1*d* which are provided in the breech part 1*b*.

By providing the damping members designed as first and second springs 8 and 5, a sort of floating mounting of the barrel and the breech system is accomplished so that a damped motion of this system within a well-defined limit relative to the surrounding housing of the arm is obtained. In the graph shown in FIG. 3, the results of operation during firing of a series of three successive shots are shown. The three lines parallel to the *x*-axis represent, sequentially from below the maximum counter-recoil $V_{max}$ of the system, the zero line, 0, the arm in the rest position, and the maximum recoil $R_{max}$. The three lines parallel to the *y*-axis represent from left to right, the consecutive shots 1, 2 and 3. As may be seen in the graph, at the first counter-recoil motion of the breech and the locking impact of the breech mass thereby produced, the first damping spring 5 comes into action and cushions the system. Upon firing of the first shot, and in response to the rearwardly directed momentum thereby produced, the zero line is crossed in a backward movement again. Consequently, the second biased damping spring 8 comes into action and is compressed during the following two shots to the maximum, whereby, the recoiling system is applied softly against the shoulder of the rifleman.

While a specific embodiment of the invention has been shown and described in detail to illustrate the application of the principles of the invention, it will be understood that the invention may be embodied otherwise without departing from such principles.

What is claimed is:

1. A firearm, particularly a short firearm for firing caseless ammunition, comprising a housing, a barrel displaceably mounted in said housing and having a bore therethrough, first and second springs supported on said housing and biasing said barrel against axial movement in respective opposite directions, said barrel having a breech portion with a cartridge chamber aligned with the bore and a magazine chamber opening into said cartridge chamber, a lock member having a forward end adjacent the barrel bore and being slidable in said cartridge chamber and having a bore therethrough and having an opposite rear end portion, a firing pin gas piston slidable in said lock member bore and, together with said lock member, sealing said cartridge chamber rearwardly of the cartridge to be fired, a locking slider having an axial bore receiving the rear end portion of said lock member, a firing pin within said back member control pin means engaged between said locking slider and said lock member to rotate said lock member during firing, and relatively axially and circumferentially movable projection and recess means defined between said lock member and said barrel breech portion which are disengaged upon firing and rotation of said lock member to release said lock member and from said rear breech portion of said barrel and permit rearward movement thereof, said projection and recess means being re-engageable upon subsequent forward movement and rotation of said lock member by said control pin means.

2. A firearm according to claim 1, wherein said first and second springs are coil springs.

3. A firearm according to claim 1, wherein said locking slider includes an interior wall with a curved track defined thereon, said firing pin having a connecting pin extending transversely thereof engaged in said curved track.

4. A firearm according to claim 3, wherein said firing pin has a bore extending transversely to its longitudinal axis and a pin extending through said bore and engaged in the curved track of said locking slider.

5. A firearm according to claim 1, wherein said first and second springs are coil springs concentrically arranged around said barrel.

6. A firearm according to claim 5, including a guide sleeve arranged in said housing between said barrel and said housing, said first and second springs being accommodated with said guide sleeve and means fixing said guide sleeve in said housing axially and rotatably.

7. A firearm according to claim 6, wherein said guide sleeve includes a shoulder on its interior intermediate its length, said gun barrel having a projection defining a shoulder on each side thereof aligned with the shoulder of said sleeve, a centering member surrounding said barrel between said sleeve and said barrel and abutting against the shoulder of said sleeve and the projection of said barrel, one of said springs abutting against said centering member, a ring carried by said sleeve forming the abutment of the opposite end of said one of said springs located at the breech end of said sleeve.

8. A firearm according to claim 7, wherein the other of said first and second springs abuts against the opposite side of said barrel projection from the first of said springs and has an opposite end toward the muzzle of said gun, said sleeve having a sleeve shoulder against which said opposite end of said second spring abuts.

* * * * *